US009157206B2

(12) United States Patent
Claeson et al.

(10) Patent No.: US 9,157,206 B2
(45) Date of Patent: Oct. 13, 2015

(54) METHOD AND DEVICE FOR APPLYING A DISPERSANT OR OTHER SUBSTANCES TO A WATER SURFACE

(76) Inventors: Magnus Claeson, Vastra Frolunda (SE); Peter Lofgren, Saltsjobaden (SE)

( * ) Notice: Subject to any disclaimer, the term of this patent is extended or adjusted under 35 U.S.C. 154(b) by 980 days.

(21) Appl. No.: 13/138,916

(22) PCT Filed: Apr. 29, 2010

(86) PCT No.: PCT/SE2010/000111

§ 371 (c)(1),
(2), (4) Date: Oct. 24, 2011

(87) PCT Pub. No.: WO2010/126426

PCT Pub. Date: Nov. 4, 2010

(65) Prior Publication Data

US 2012/0039669 A1 Feb. 16, 2012

(30) Foreign Application Priority Data

Apr. 30, 2009 (SE) ..... 0900589

(51) Int. Cl.

| | |
|---|---|
| ***B63B 21/56*** | (2006.01) |
| ***E02B 15/04*** | (2006.01) |
| ***E02B 15/08*** | (2006.01) |
| *B63B 35/32* | (2006.01) |

(52) U.S. Cl.

CPC ..... *E02B 15/041* (2013.01); *E02B 15/0842* (2013.01); *B63B 21/56* (2013.01); *B63B 35/32* (2013.01)

(58) Field of Classification Search

CPC ..... B63B 35/32; B63B 21/56; E21B 43/0122; E02B 15/04; E02B 15/041; E02B 15/0842; E02B 15/0411

USPC ..... 114/242, 244, 245, 246; 239/159, 160, 239/164, 169; 405/60, 63–72

See application file for complete search history.

(56) References Cited

U.S. PATENT DOCUMENTS

| | | | | |
|---|---|---|---|---|
| 2,793,717 | A * | 5/1957 | Camburn | 403/81 |
| 6,418,872 | B1 * | 7/2002 | Cour | 114/312 |
| 6,517,726 | B2 * | 2/2003 | Allen et al. | 210/749 |

* cited by examiner

*Primary Examiner* — S. Joseph Morano
*Assistant Examiner* — Andew Polay
(74) *Attorney, Agent, or Firm* — Gary K. Price

(57) ABSTRACT

The present invention relates to a method for applying a dispersant or other substances to a water surface. The invention also relates to a device for carrying out the method according to the present invention. Significant for the method according to the present invention is in that a nozzle hose system is used, said system comprising a hose (1) or a set of hoses, that the hose (1) or set of hoses is elevated at both ends, that one end of the hose (1) or set of hoses is based at an operation unit (6), and that the other end of the hose (1) or set of hoses is connected to a paravane (9; 109; 209) that is towed by or connected to the operation unit (6).

6 Claims, 5 Drawing Sheets

METHOD AND DEVICE FOR APPLYING A DISPERSANT OR OTHER SUBSTANCES TO A WATER SURFACE

TECHNICAL FIELD OF THE INVENTION

The present invention relates to a method and device for applying a dispersant or other substances to a water surface.

PRIOR ART

A known technique to apply a dispersant or other substances to a water surface includes spray arms that are provided on a boat, said spray arms being equipped with nozzles to spray suitable substances on the water surface. However, the substance application rate of such systems are limited and are also sensitive to roll.

Objects and Features of the Invention

A primary object of the present invention is to present a method and a device that in a wide swath applies a dispersant or other substances to a water surface.

A further object of the present invention is to operate the method and the device by few persons.

Still an object of the present invention is to control the components of the device in order to make them perform in a proper way.

At least the primary object of the invention is fulfilled by the attached independent claim 1. Preferred embodiments of the invention are defined in the dependent claims.

BRIEF DESCRIPTIONS OF THE DRAWINGS

Figure 1:
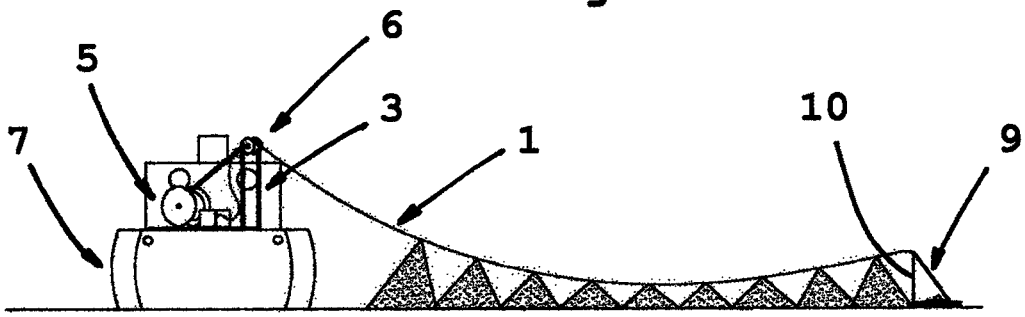
Figure 2:
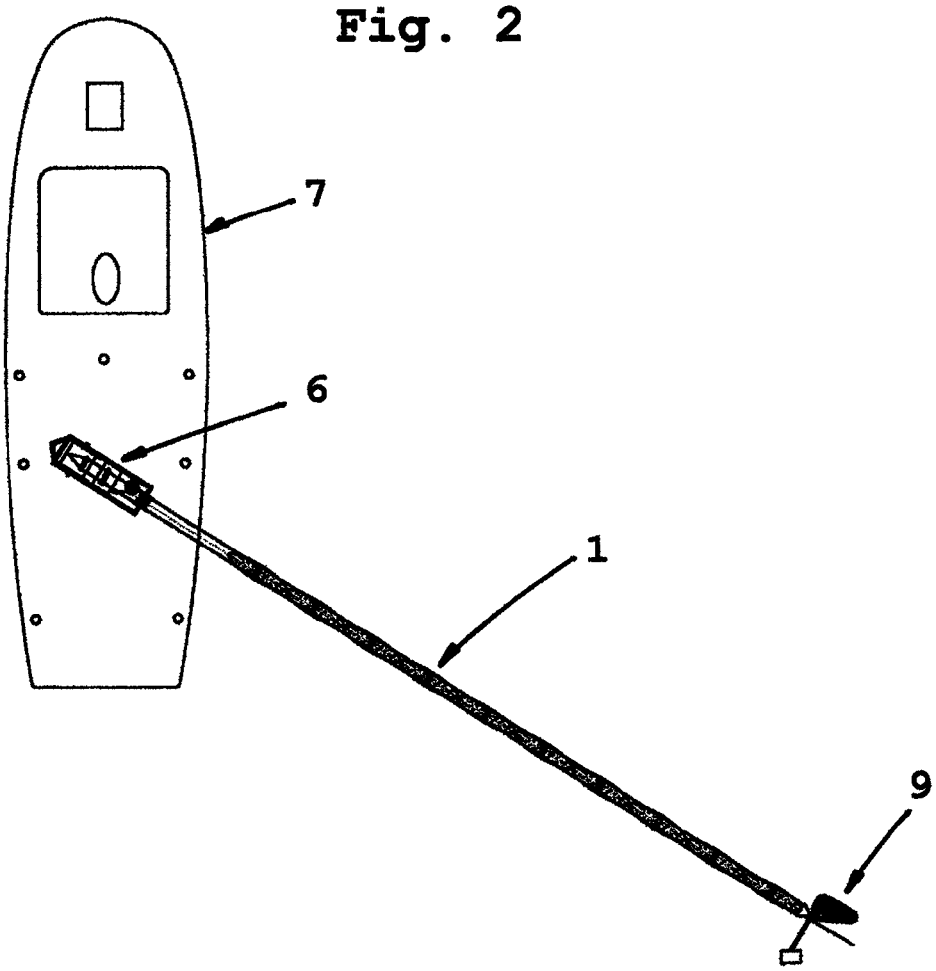
Figure 3:
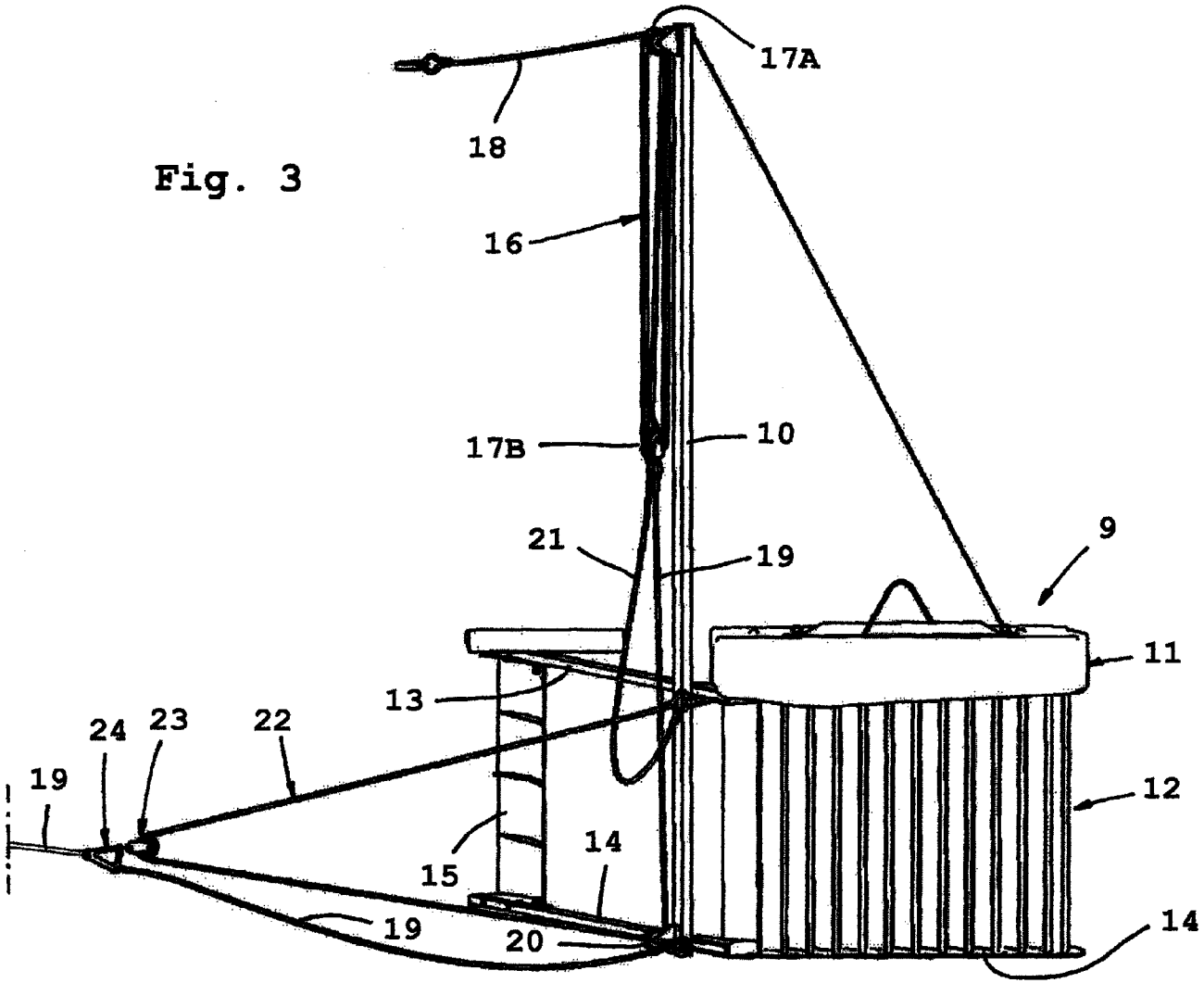
Figure 4:
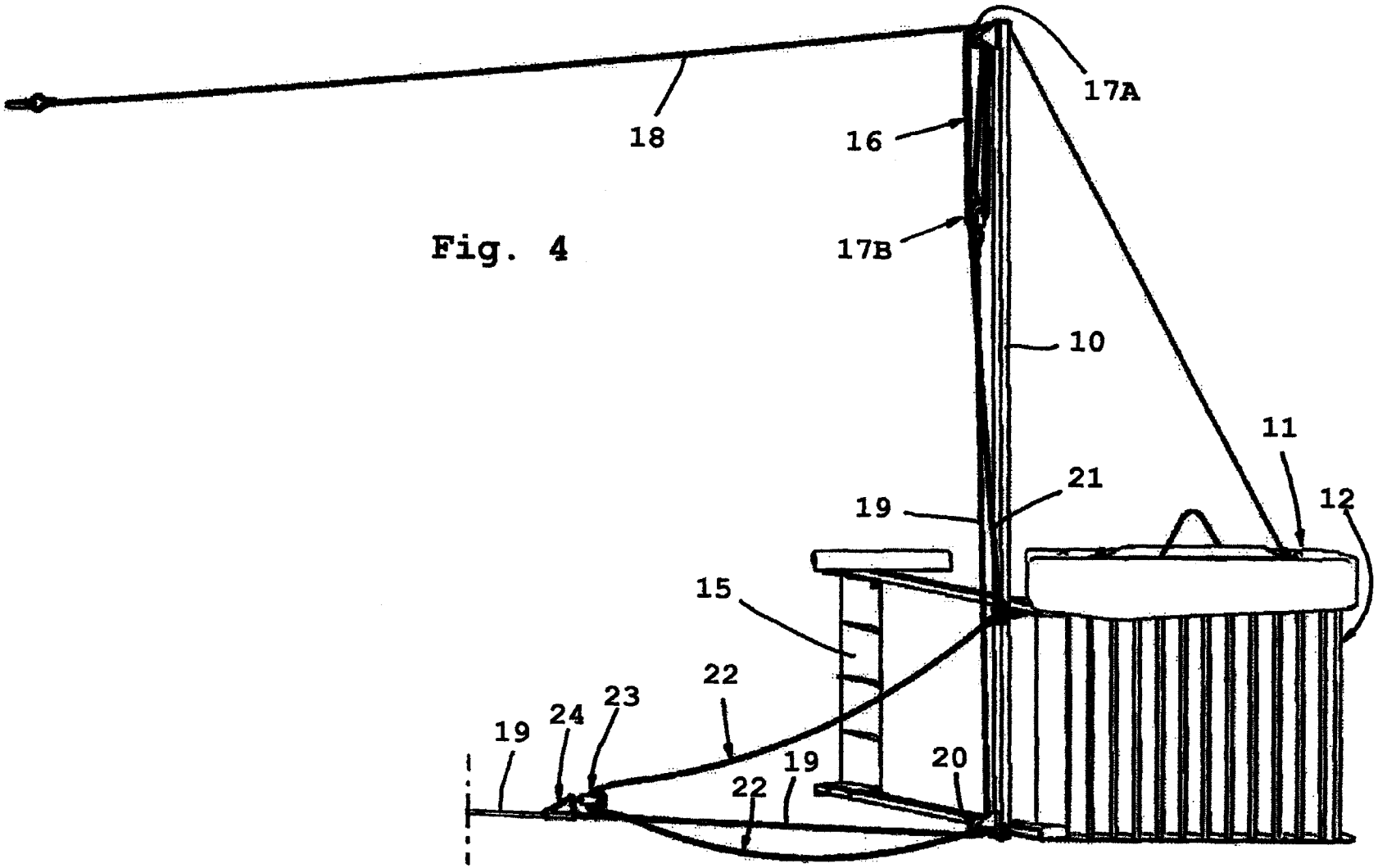
Figure 5:
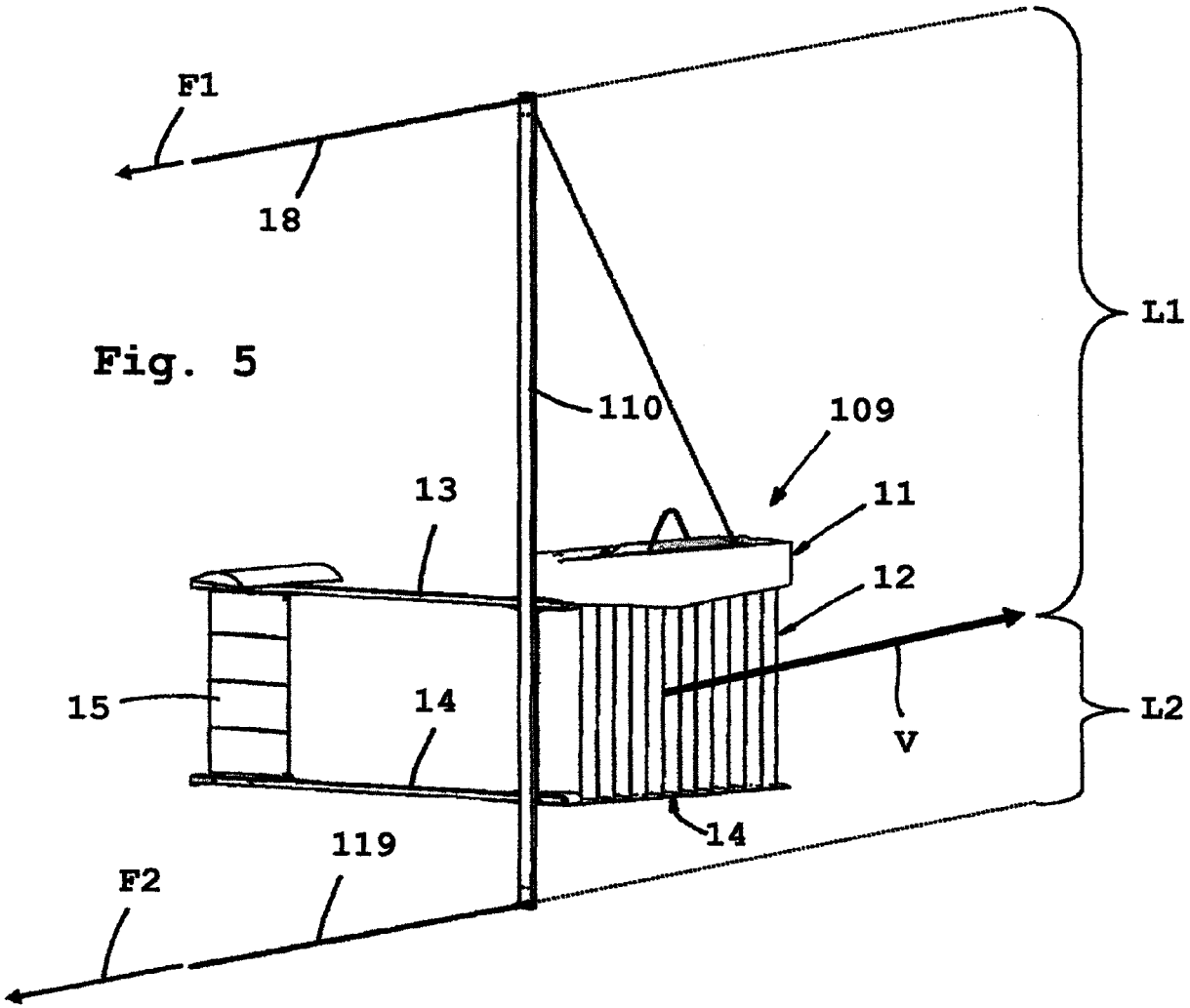
Figure 6:
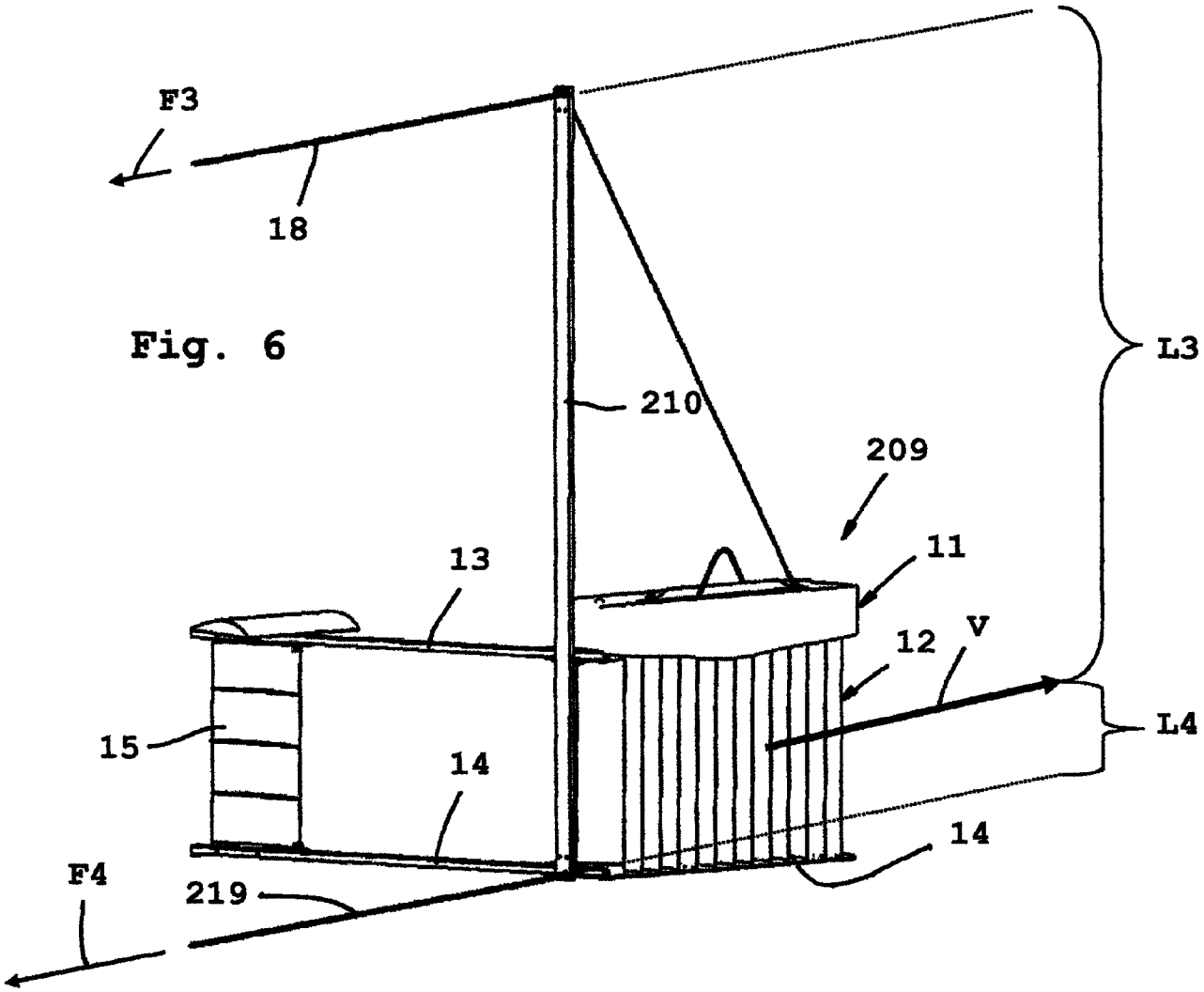

Below preferred embodiments of the invention will be described, reference being made to the accompanying drawings, where:

FIG. 1 discloses a view from behind of a device according to the present invention;

FIG. 2 discloses a top view of the device according to FIG. 1;

FIG. 3 discloses a schematic perspective view of a paravane that constitutes a part of the device according to the present invention, said paravane being in a first operating mode;

FIG. 4 discloses a schematic perspective view of the paravane according to FIG. 3 in a different operation mode;

FIG. 5 discloses a schematic perspective view of a manually controlled paravane; and FIG. 6 discloses an alternative embodiment of a manually controlled paravane.

DETAILED DESCRIPTION OF A PREFERRED EMBODIMENTS OF THE INVENTION

The device according to the present invention comprises a nozzle hose system including a hose 1 that is equipped with a number of nozzles that are distributed along the longitudinal direction of the hose 1. The nozzles are not disclosed in detail but they constitute nozzles of common design, said nozzles being designed to perform an effective spray action when the used substances are discharged through said nozzles.

The device according to the present invention also comprises means to store the hose 1, to elevate the hose and to pump substances into the hose in order to have the substances to be discharged through the nozzles of the hose 1. In FIG. 1 is schematically shown an extendable first mast 3 to elevate the hose 1 and a reel 5 to store the hose 1. In the disclosed embodiment the extendable first mast 3, the reel 5 and the pump preferably constitutes a operation unit 6 that is located on a vessel 7. Since the first mast 3 is extendable the height above the water of the end of the hose 1 that is attached to the first mast 3 may be varied.

As is evident from FIGS. 1 and 2 the device according to the present invention also comprises a paravane 9 that is connected to the free end of the hose 1, i.e. the end of the hose 1 that is remote from the extendable mast 3. The paravane 9 is equipped with a second mast 10 to allow the hose 1 to be elevated relative to the water surface when connected to the paravane 9.

The anti-tilt control of the paravane 9 may be carried out automatically, and the anti-tilt means of the paravane 9 are schematically illustrated in FIGS. 3 and 4. Generally, the paravane 9 comprises a floatation body 11 and a cascade/wing assembly 12 provided below the floatation body 11, said cascade 12 being supported by upper and lower arms 13 and 14 that constitutes a frame of the paravane 9. Each arm 13, 14 comprise two portions that in top view of each arm 13, 14 are angled relative each other. The paravane 9 also comprises a balance rudder 15 that likewise is supported by the arms 13, 14.

The paravane 9 is equipped with a running tackle 16 that extends along the second mast 10. At the top of the second mast 10 of the paravane 9 a first block 17A of the running tackle 16 is provided. Said first block 17A is fixed to the second mast 10 and comprises a number of first sheaves. A pre-tension line 18 runs through the first block 17A and through the second block 17B via a number of turns. Thereby, the running tackle 16 is achieved. The second block 17B being freehanging at a lower level than the first block 17A. The second block 17B comprises a number of second sheaves. The pre-tension line 18 extends between the paravane 9 and the vessel 7. A tow line 19 that extends between the paravane 9 and the vessel 7 runs through a third sheave 20 that is provided at the intersection between the lower arm 14 and the second mast 10, said tow line 19 extending along the second mast 10 and is fastened to the second block 17B of the running tackle 16. In this connection it should be pointed out that the third sheave 20 need not be located at the level of the lower arm 14. Within the scope of the present invention it is possible that the third sheave 20 is located beneath the lower arm 14 or above the lower arm 14. The location of the third sheave 20 depends on a number of parameters, e.g. the length of the second mast 10.

A restriction line 21 for the running tackle 16 is having one end fastened to the second block 17B of the running tackle 16 and the other end fastened to the second mast 10 at the level of the upper arm 13. The function of the restriction line 21 will be described below.

The paravane 9 according to the described embodiment also comprises a bridle 22 that via a bridle block 23 is connected to a connector plate 24 of the tow line 19. The rope ends of the bridle 22 are connected to the intersections between the arms 13, 14 and the second mast 10.

FIG. 3 depicts the operating mode of the paravane 9 when it is lowered into the water and before the hose 1 is extended between the paravane 9 and the vessel 7. In this operating mode the paravane 9 is towed from the vessel 7 by a part of the tow line 19 and the bridle 22. As is evident from FIG. 3 the part of the tow line 19 that extends between the connector plate 24 and the vessel 7 is an active part of the tow line 19 together with the bridle 22. In this mode of operation of the paravane 9 the pre-tension line 18 is not taut but is extending between the paravane 9 and the vessel 7. When the paravane 9 has reached a position at a desired distance from the vessel 7 the pre-tension line 18 is tightened in order to support the nozzle hose 1 whereby the length of the running tackle 16 is shortened. This results in that the connector plate 24 is displaced towards the paravane 9 and the bridle 22 is slackened. Thus the tow force is transferred from the bridle 22 to the lower tow point that is represented by the second sheave 20. Now the part of the tow line 19 that extends between the connector plate 24 and the second sheave 20 will be tightened and the second sheave 20 will absorb the load previously born by the bridle 22. This is illustrated in FIG. 4 and also that the bridle 22 is slackened.

When the length of the running tackle 16 is shortened the restriction line 21 is tightened and limits the movement of the running tackle 16 to prevent it from interfering with the other end of the running tackle 16. The vertical positioning of the lower tow point dictates the number of turns required in said running tackle 16. When the paravane 9 is properly balanced, i.e. the anti-tilt means are in operation, the hose 1 is brought to assume its desired hose catenary curve. This is effected by a pulling line (not shown) that extends along the pre-tension line 18, said pulling line pulling the hose 1 along the pre-tension line 18 in order to suspend the hose 1 in parallel with the pre-tension line 18. Some kind of suspension means (not shown) are provided between the pre-tension line 18 and the hose 1, said suspension means being slidable relative to the pre-tension line 18. The described anti-tilt means make it possible for a single person to carry out the launching of the paravane 9.

In FIG. 5 a modified embodiment of a paravane 109 is disclosed, said paravane 109 being suitable for manual control. Components of both embodiments that are essentially the same are given identical reference numerals. The most significant difference of the paravane 109 compared to the paravane 9 described above is that the there is no bridle and the second mast 110 extends downwards beyond the cascade 12. This structural modification is sometimes necessary to balance the pulling force F1 in the pre-tension line 18 that extends between the paravane 109 and the vessel 7. The end of the pre-tension line 18 remote from the paravane 109 is normally connected to a first winch that is located on the vessel 7.

The pulling force F1 in the pre-tension line 18 has a lever arm L1 in regard to a horizontal force vector V of the paravane 109. The force F1 and the lever arm L1 generates a first moment.

A tow line 119 extends from the lower end of the second mast 110 to the vessel 7. The end of the tow line 119 remote from the paravane 109 is normally connected to a second winch located on the vessel 7. The pulling force F2 in the tow line 119 has a lever arm L2 in regard to the horizontal force vector V and the force F2 and the lever arm L2 generates a second moment. In order to balance the paravane 109 in the water the first moment and the second moment should be equal. Also F1+F2=V. The winches on the vessel 7 are used to regulate the distance of the paravane 109 from the vessel 7 and also to maintain the second mast 10 of the paravane 109 relatively vertical and thus to maintain stability of the paravane 109.

In FIG. 6 a further embodiment of a paravane 209 is disclosed, said paravane 209 being a slightly modified version of the paravane 109. Thus, the paravane 209 is suitable for manual control. The difference between the paravane 209 and the paravane 109 is that the second mast 210 is shorter than the second mast 110, i.e. the second mast 210 has its lower end at the level of the lower arm 14.

The force F3 of the pre-tension line 18 has a lever arm L3 in regard to a horizontal force vector V of the paravane 209. The force F3 and the lever arm L3 generates a first moment.

The force F4 in the tow line 219 has a lever arm L4 in regard to the horizontal force vector V and the force F4 and the lever arm L4 generates a second moment. In order to balance the paravane 209 in the water the first moment and the second moment should be equal. Also F3+F4=V. The winches on the vessel 7 are used to regulate the distance of the paravane 209 from the vessel 7 and also to maintain the second mast 10 of the paravane 209 relatively vertical and thus to maintain stability of the paravane 209.

Feasible Modifications of the Invention

The disclosed embodiment of the present invention relates to coastal/small scale version. However, within the scope of the present invention also an offshore/large scale version is possible. Then a larger vessel is used and also a larger paravane. Such large scale version could be operated with a hose that is equipped with a selective nozzle system, i.e. individually controlled nozzles or sets of nozzles. Thereby, it is possible to activate individual segments of the total system swath. It is also possible that the large scale version has a set of hoses comprising multiple, parallel hoses. If multiple, parallel hoses are used the hoses may have nozzles only along a segment of the total length between the first and second masts 5 and 10. This will allow for application of substances, e.g. a dispersant, on segments of the swath while the vessel 7 maintains a set course. A remotely controlled valve system for the nozzles is envisaged. Also, within the scope of the invention substance registering sensors may be used to this end, said sensors registering oil on the water.

In the embodiment described above the device according to the present invention is used together with a vessel. However, within the scope of the present invention it is also feasible that the operation unit 6 is stationary, i.e. not located on a vessel 7 as in the embodiment described above. For instance, said operation unit 6 may be located on a bank of a river and the paravane 9 is in the streaming water of the river.

In the embodiment of FIGS. 3 and 4 a running tackle 16 is provided. However, within the scope of the present invention it is also feasible to use other means to provide the transmission ratio between the forces in the pre-tension line and the tow line. In exemplifying and non-restrictive purpose a hydraulic cylinder or a ball screw may be considered.

Alternatively, the hydraulic cylinder could act directly on the tow line and apply a suitable force to the tow line in order to pull the tow line towards the paravane and thereby release the bridle.

We claim:

1. Method for applying a dispersant or other substances to a water surface, characterized in that the method uses a nozzle hose system comprising a hose (1) or a set of hoses that extend in parallel with a pre-tension line connected between a paravane (9; 109; 209) and a vessel (7), that the hose (1) or set of hoses is elevated relative to the water surface at both ends, that one end of the hose (1) or set of hoses is based at an operation unit (6) on the vessel (7), and that the other end of the hose (1) or set of hoses is connected to the paravane (9; 109; 209) that is towed by or connected to the operation unit (6), wherein the paravane (9; 109; 209) including a running tackle (16), and wherein a selected length of the running tackle (16) functions to transfer a tow force.

2. Device for applying a dispersant or other substances to a water surface, characterized in that the device comprises a nozzle hose system including a hose (1) or a set of hoses that extend in parallel with a pre-tension line connected between a paravane (9; 109; 209) and a vessel (7), said hose (1) or set of hoses equipped with nozzles distributed along the length of the hose (1) or the set of hoses, a first mast (3) at one end of the hose (1) or the set of hoses is based at an operation unit (6) on the vessel (7), and a second mast (10) at the other end of the hose (1) or set of hoses is based on the paravane (9; 109; 209), the first mast (3) and the second mast (10) function to elevate both ends of the hose (1) or set of hoses relative to the water surface, and towing or connecting means for towing or connecting the paravane (9; 109; 209) by or to the vessel (7).

3. Device according to claim 2, characterized in that the nozzle hose system comprises a pre-tension line (18) that extends between the paravane (9; 109; 209) and the operation unit (6), and a pulling line configured to suspend the hose (1) or the set of hoses along the pre-tension line (18).

4. Device according the claim 3, characterized in that the first mast (5) is extendable.

5. Device according to claim 3, wherein an anti-tilt control includes a running tackle (16) that extends along the second mast (10) of the paravane (9), the pre-tension line (18) runs through first block (17A) disposed at a top end of the second mast (10) and through a second block (17B), the second block (17B) being lower than the first block (17A), that said pre-tension line (18) runs from the top end of the second mast (10) to the operating unit (6), and the tow line (19) is connected to the second block (17B) extending to the operation unit (6).

6. Device according to claim 5, wherein a selected length of the running tackle (16) functions to transfer a ratio of forces between a pre-tension line (18) and a tow line (19).

* * * * *